US009359739B2

(12) United States Patent
Clements

(10) Patent No.: US 9,359,739 B2
(45) Date of Patent: Jun. 7, 2016

(54) GUY ANCHOR REMEDIATION APPARATUS

(71) Applicant: Glaus, Pyle, Schomer, Burns & Dehaven, Inc., Akron, OH (US)

(72) Inventor: Kevin Clements, Seven Hills, OH (US)

(73) Assignee: Glaus, Pyle, Schomer, Burns & Delhaven, Inc., Akron, OH (US)

( * ) Notice: Subject to any disclaimer, the term of this patent is extended or adjusted under 35 U.S.C. 154(b) by 0 days.

(21) Appl. No.: 14/300,261

(22) Filed: Jun. 10, 2014

(65) Prior Publication Data

US 2015/0152619 A1 Jun. 4, 2015

Related U.S. Application Data

(60) Provisional application No. 61/911,109, filed on Dec. 4, 2013.

(51) Int. Cl.
*E02D 5/80* (2006.01)
*E02D 5/74* (2006.01)

(52) U.S. Cl.
CPC .. *E02D 5/80* (2013.01); *E02D 5/74* (2013.01); *E02D 5/808* (2013.01)

(58) Field of Classification Search
CPC ..... E02D 5/803; E02D 5/74; E02D 5/765; E02D 27/12; E02D 27/42; E02D 5/64; E02D 5/60; E02D 5/80; B25B 25/00; C23F 13/02; E01D 22/00; E04H 12/20
USPC ..... 52/514, 514.5, 148, 155, 156, 157, 165, 52/295, 741.11, 741.15, 745.21
See application file for complete search history.

(56) References Cited

U.S. PATENT DOCUMENTS

| | | | | | |
|---|---|---|---|---|---|
| 1,569,068 | A * | 1/1926 | Blackburn | 52/159 |
| 1,584,420 | A * | 5/1926 | Barnard | 52/159 |
| 1,714,187 | A * | 5/1929 | Pacy | 29/897.1 |
| 1,964,610 | A * | 6/1934 | Wagner | 52/159 |
| 2,252,379 | A * | 8/1941 | Johns | 52/166 |
| 2,851,414 | A * | 9/1958 | Hubbard | 204/196.2 |
| 2,899,029 | A * | 8/1959 | Ballew | 52/159 |
| 3,797,182 | A * | 3/1974 | Eichstaedt | 52/156 |
| 3,839,835 | A * | 10/1974 | Meyer | 52/296 |
| 3,903,662 | A * | 9/1975 | Gabliya et al. | 52/741.14 |
| 3,918,229 | A * | 11/1975 | Schweinberger | 52/295 |
| 4,203,267 | A * | 5/1980 | Langhorst | 52/148 |
| 5,437,519 | A * | 8/1995 | Bullivant | 405/239 |
| 5,561,931 | A * | 10/1996 | Duenkel | 40/606.11 |
| 6,315,876 | B1 * | 11/2001 | Delahoyde et al. | 204/196.06 |
| 6,474,028 | B2 * | 11/2002 | Cusimano et al. | 52/153 |
| 8,250,817 | B2 | 8/2012 | Reyes | |
| 8,458,986 | B2 | 6/2013 | Reyes | |
| 2006/0151761 | A1 * | 7/2006 | Stevens | 254/232 |
| 2013/0000244 | A1 | 1/2013 | Reyes | |

FOREIGN PATENT DOCUMENTS

| | | | |
|---|---|---|---|
| AT | 360435 T | * | 5/1973 |
| FR | EP 0046714 A1 | * | 3/1982 |
| FR | 2745829 A1 | * | 9/1997 |

* cited by examiner

*Primary Examiner* — Joshua J Michener
*Assistant Examiner* — Matthew Gitlin
(74) *Attorney, Agent, or Firm* — FisherBroyles, LLP; W. Scott Harders

(57) ABSTRACT

A reinforcing system and/or means for reinforcing guyed structures or guyed construction techniques by supplementing or retrofitting the current anchoring system with a revised anchoring system which attaches or adapts to the current anchoring system.

9 Claims, 10 Drawing Sheets

GUY ANCHOR REMEDIATION APPARATUS

RELATED APPLICATIONS

This application claims priority to and is a non-provisional of U.S. Provisional Patent Application No. 61/911,109 filed Dec. 4, 2013, entitled "Guy Anchor Remediation Apparatus," the contents of which is incorporated by reference.

FIELD OF THE INVENTION

A reinforcing system and/or means for reinforcing guyed structures or guyed construction techniques by supplementing or retrofitting the current anchoring system with a revised anchoring system which attaches or adapts to the current anchoring system.

BACKGROUND OF THE INVENTION

Towers and transmission towers are utilized in multiple industries including radio, television, and cellular phone. Towers are also used in the power transmission and wind turbine industries. One type of tower (or structure) is known as a guyed structure or alternatively an additionally guyed structure. In both, guy wires (or guy anchors) are attached when the construction has to withstand strong forces in a certain direction (typically wind). Guy wires assist in maintaining the structure in a vertical position. In a standard arrangement the structures having a main body (mast) which stands on top of a base. The base usually being a concrete structure or slab, or any number of materials able to maintain the loads required. Guy wires then attach to the structure/mast and extend down and away from the mast. The guy wires are fixed securely to the ground via an anchor.

Triangulation is often employed as the means of securing the structures, though any number (1, 2, 3, 4 and more) of guyings are possible to secure a structure. In a triangular setup at least three guy anchors are provided approximately 120 degrees from one another to provide a stable means of keeping the mast vertical. In other embodiments the structure utilizes more than 3 guy anchors either in an array circumferentially around the mast or by attaching at various heights along the mast. Other known structures include H-framed structures (which require addition guying, such as 6, 12 or more guying arrangements), utility poles, signs, billboards, electrical substations, water tanks, turbines, stacks and other structures.

The termed "guyed structure" being a structure whose masts have no independent means of support, relying entirely on guy wires to hold them upright. The term "additional guyed structures" being a structure which needs guy wires for reinforcement and stability. A guyed structure or an additional guyed structure being cheaper than a completely free-standing structure, while withstanding the same force(s). Guying can also allow for an easy upgrade of existing structures. The disadvantages of guying is that it requires more ground space than a free standing structure and that the guy anchors may handicap nearby agriculture. There also exists the danger that the guys could be damaged at their anchors, requiring fencing to keep potential vandals away.

One major problem regarding guyed structure anchors is corrosion of the means securing to the ground. Another problem encountered is the need to strengthen an existing guy anchor to give it more capacity. In a standard setup the anchor is a concrete block buried below grade (underground). Into this concrete block is affixed a guy anchor shaft of varying lengths. This guy anchor shaft originating in the block underground and emerging above ground and adhering to a collar, head or other means of affixing to a wire or cable which then affixes to the mast. This guy anchor shaft being below ground is exposed to water, soil and other contaminants. With the nature of the materials used being typically metal, galvanic corrosion is one concern and as such, grounding spike(s) are often utilized. Corrosion may also be electrolytic in nature. This ongoing corrosion eventually leading to a loss of material from the guy anchor shaft and with the accompanied tensile forces from the strains of the mast, eventually leading to anchor shaft failure. If not remedied, structure failure may follow as a result. In order to avoid structure failure, a means of further securing the guy wire attachment to the foundation (or anchor) is needed.

Owners of the guyed structures utilize a variety of means for remediating the structure to prevent failure, but all have drawbacks due to costs, ease of installation or usefulness of the remediation. Known methods include inspection (ex: visual, electronic or other non-destructive means) of the anchor shafts, installing a new dead man anchor in front of the corroded anchor, installing a new anchor behind the corroded anchor and/or installing a new drilled pier anchor to offset to one side of the corroded anchor. Some of these methods requiring replacement or relocation of the guy wires or anchors or may not be sufficient to withstand the stresses involved. Also known in the art are attempts to create a new (second) concrete anchor above the existing anchor as are described in US Patent Application 2013/0000244, and U.S. Pat. Nos. 8,458,986 and 8,250,817.

SUMMARY OF THE INVENTION

In one embodiment the present invention details a remediation system for a guy anchor shaft of a guyed structure or additionally guyed structure comprising an assembly which attaches to a guy anchor fan plate and/or the guy anchor shaft, an anchor, one or more remediation shafts which extend from the assembly and are secured to the anchor, the assembly further having one or more remediation shaft receptacles which accept and secure the one or more remediation shafts and a guy anchor shaft attachment able to accept and further secure the guy anchor shaft, the one or more remediation shaft receptacles being aligned in parallel or at up to a 40 degree angle with the guy anchor shaft and the one or more remediation shaft receptacles being affixed to the guy anchor shaft attachment and/or the guy anchor fan plate via a joining plate.

In another embodiment, the present invention details a method for installing a remediation system for a guy anchor shaft of a guyed structure or additionally guyed structure comprising installing an assembly having one or more remediation shaft receptacles which accept and secure one or more remediation shafts and also having a guy anchor shaft attachment which accepts and further secures to a guy anchor fan plate and/or the guy anchor shaft, installing the one or more remediation shafts which extend from the assembly and are secured to an anchor, aligning the one or more remediation shaft receptacles in parallel or at up to a 40 degree angle with the guy anchor shaft and affixing the one or more remediation shaft receptacles to the guy anchor shaft attachment via a joining plate.

BRIEF DESCRIPTION OF THE DRAWINGS

The foregoing and other objects, aspects, and advantages will be better understood from the following description of exemplary embodiments of the disclosure with reference to the drawings, in which.

DETAILED DESCRIPTION OF THE INVENTION

Figure 1:
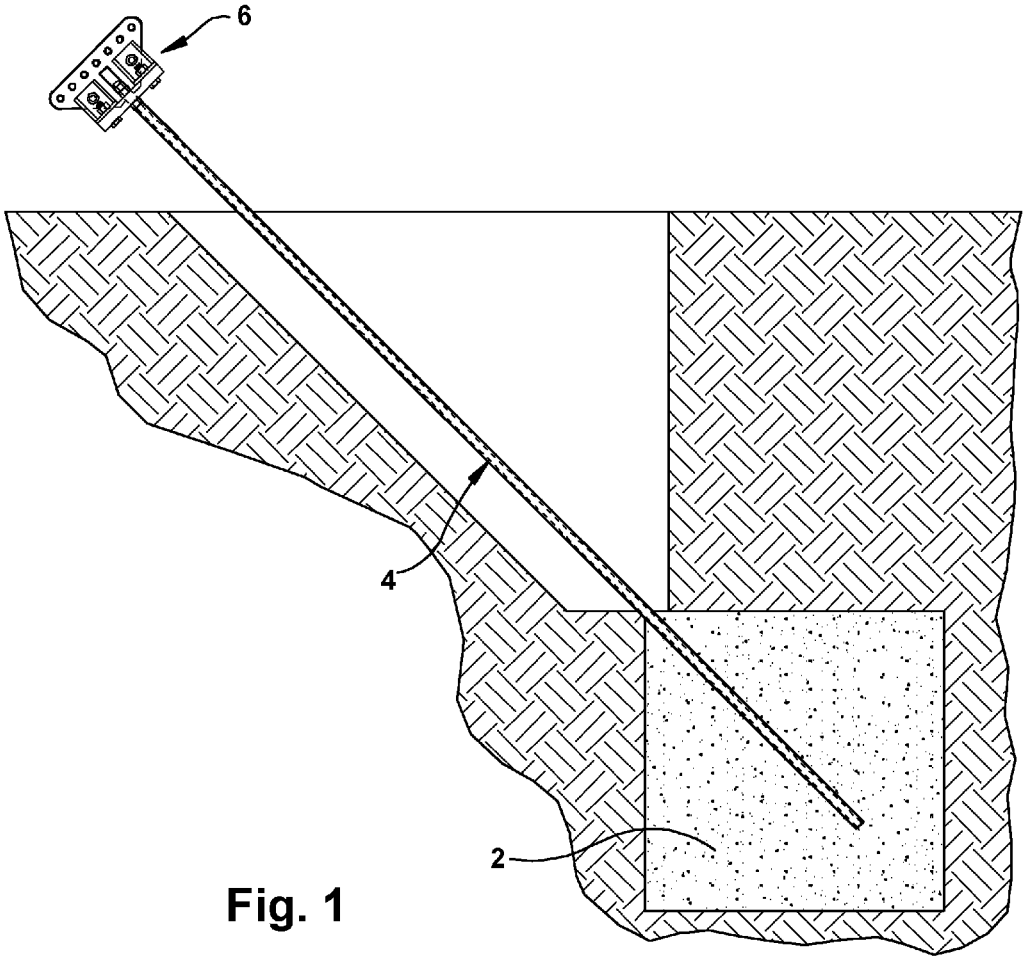
FIG. 1 is a drawing of a below grade installation of the present invention.

A reinforcing system and/or means for reinforcing guyed structures or guyed construction techniques by supplementing or retrofitting the current anchoring system with a revised anchoring system which attaches or adapts to the current anchoring system.

Reference will now be made in detail to exemplary embodiments of the disclosure, which are illustrated in the accompanying drawings. Whenever possible, the same reference numerals will be used throughout the drawings to refer to the same or like parts. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The following definitions and embodiments are used to describe a typical guy wire/guy anchor setup prior to remediation by the present invention. FIG. 1 detailing a typical below grade installation. Here anchor 2 is a heavily weighted device, typically concrete or metal, which is buried below grade. While anchor 2 is typically poured concrete, any means of weighting and securing can be utilized and is not limited to concrete blocks or concrete mass. Guy anchor shaft 4 is one or more rods or shafts, usually made from metal, which at one end extend into anchor 2 a set distance and is typically secured by pouring concrete around guy anchor shaft 4, and at the other end guy anchor shaft 4 extends above grade and is attached to a transition device. While guy anchor shaft 4 is typically made from metal, other options may include, but are not limited to galvanized metal, epoxy coated metal and concrete encased metal. The shape of guy anchor shaft 4 may be, but is not limited to, flat plate, round, angle, double angle, channel, double channel or other shaped rods. The transition device typically being guy anchor fan plate 6 which is attached to guy anchor shaft 4 at one end and to one or more guy wires 8 at the other end via turnbuckles or other similar hardware. Guy anchor fan plate is usually made from metal. Finally, guy wire(s) 8 are one or more means of securing the structure which are typically metal and at one end are attached to the guy anchor fan plate 6 and at the other end attach to the structure. Guy wire(s) 8 typically being single strand, multi strand or bridge strand metal based materials.

In one embodiment the present invention details a remediation system for a guy anchor shaft of a guyed structure or additionally guyed structure comprising an assembly which attaches to a guy anchor fan plate and/or the guy anchor shaft, an anchor, one or more remediation shafts which extend from the assembly and are secured to the anchor, the assembly further having one or more remediation shaft receptacles which accept and secure the one or more remediation shafts and a guy anchor shaft attachment able to accept and further secure the guy anchor shaft, the one or more remediation shaft receptacles being aligned in parallel or at up to a 40 degree angle with the guy anchor shaft and the one or more remediation shaft receptacles being affixed to the guy anchor shaft attachment and/or the guy anchor fan plate via a joining plate.

In another embodiment, the present invention details a method for installing a remediation system for a guy anchor shaft of a guyed structure or additionally guyed structure comprising installing an assembly having one or more remediation shaft receptacles which accept and secure one or more remediation shafts and also having a guy anchor shaft attachment which accepts and further secures to a guy anchor fan plate and/or the guy anchor shaft, installing the one or more remediation shafts which extend from the assembly and are secured to an anchor, aligning the one or more remediation shaft receptacles in parallel or at up to a 40 degree angle with the guy anchor shaft and affixing the one or more remediation shaft receptacles to the guy anchor shaft attachment via a joining plate.

Figure 2:
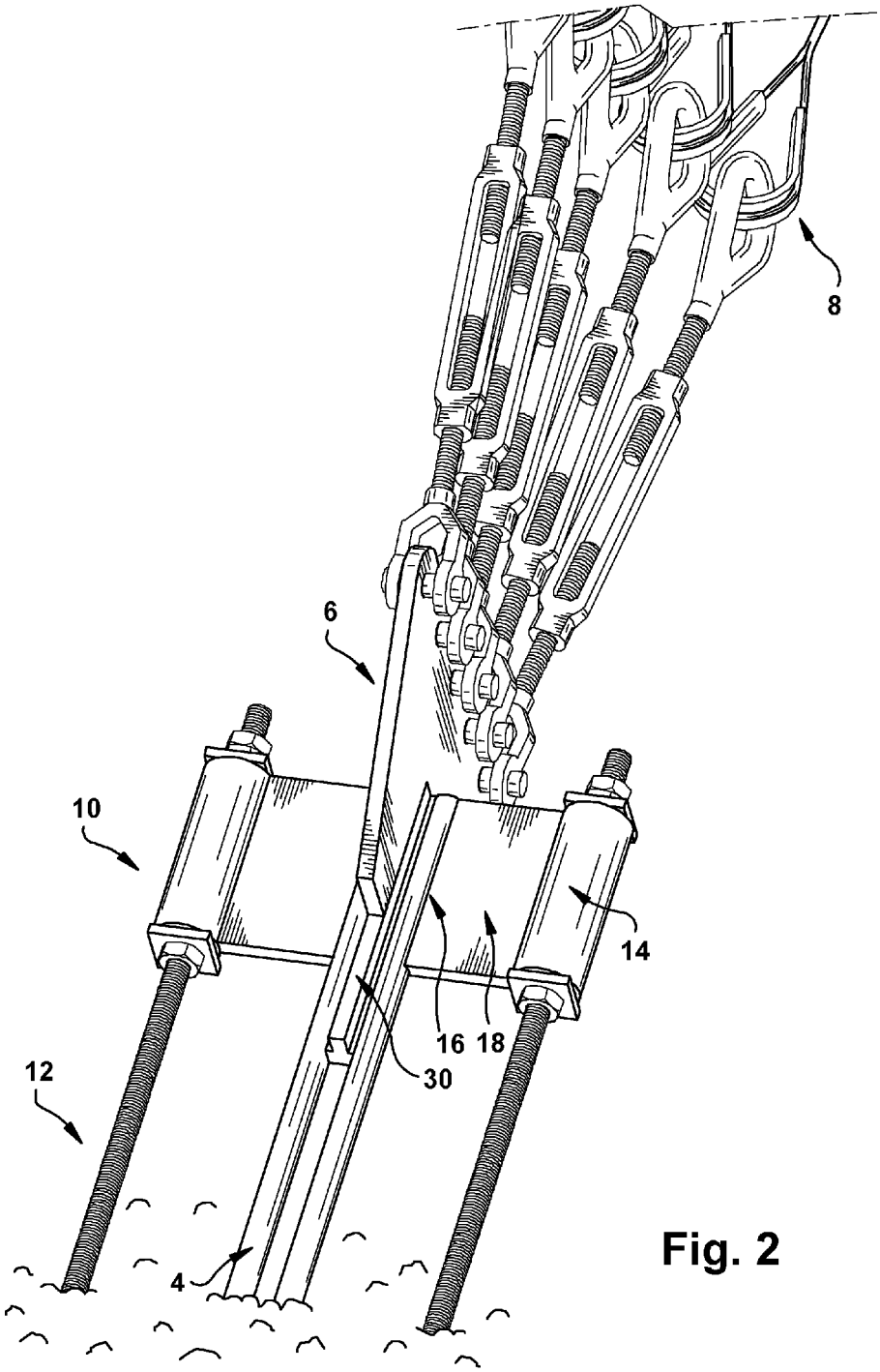
FIG. 2 is a drawing of above grade portion of the present invention.

FIG. 2 provides an above ground detail of one embodiment of the present invention. The following descriptions are features of a typical embodiment of the invention, though slight alterations are possible based on the needs of the user in a given situation. A guy anchor remediation assembly ("assembly") 10 which attaches to the guy anchor shaft 4 and has one or more remediation shafts 12 which extend from assembly 10 into the anchor 2 at a point other than where the guy anchor shaft attaches. Assembly 10 further attaching to the original guy anchor shaft 4. Assembly 10 further having one or more remediation shaft receptacles 14 able to accept and secure one or more remediation shafts 12. Assembly 10 having a guy anchor shaft attachment 16 able to accept and further secure guy anchor shaft 4. The one or more remediation shaft receptacles 14 being aligned in parallel (or at up to a 40 degree angle) with the guy anchor shaft 4 and the one or more remediation shaft receptacles 14 being affixed to the guy anchor shaft attachment 16 via joining plate 18. The entire assembly typically being made from a metal. Assembly 10 attaching to guy anchor fan plate 6 and/or guy anchor shaft 4 either by bolting or welding. FIG. 2 also detailing pinch plate 30, which can be installed to prevent pinching of existing rods in a scenario where joining plate 18 extends down past the existing fan plate connection.

Figure 3:
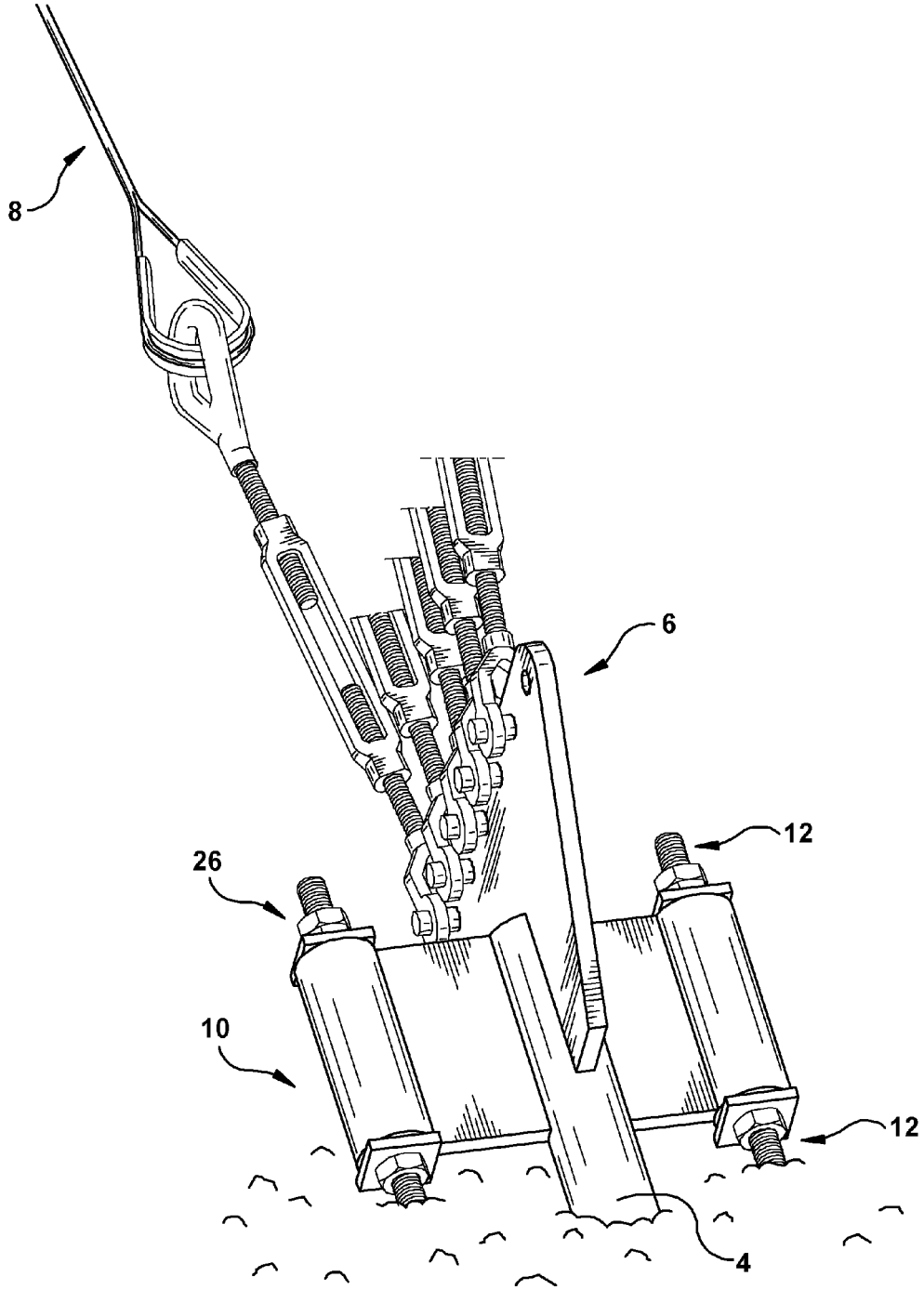
FIG. 3 is another drawing of above grade portion of the present invention.

FIG. 3 provides another drawing of one embodiment of the present invention in use. In both FIGS. 2 and 3 the assembly being fully installed and in use on a guyed structure. Guy anchor shaft 4 in FIG. 2 being a dual shaft and in FIG. 3 being a singular shaft. Both guy anchor shafts 4 being directly welded to guy anchor fan plate 6. Assembly 10 being either welded to guy anchor shaft 4 and/or guy anchor fan plate 6 via normal welding techniques or in the alternative using a bolting mechanism to adhere to same. In one embodiment bolting mechanism passing through assembly 10 and guy anchor fan plate 6. In most instances, assembly 10 resting above grade and not touching the ground but as is seen in FIG. 3, optionally assembly 10 may come into contact with the ground. Keeping the assembly off of and not in contact with the soil/ground allowing for better protection from corrosion. In addition, keeping a slight angle to the assembly allowing rain water and other contaminant to drain away from assembly 10.

Figure 4:
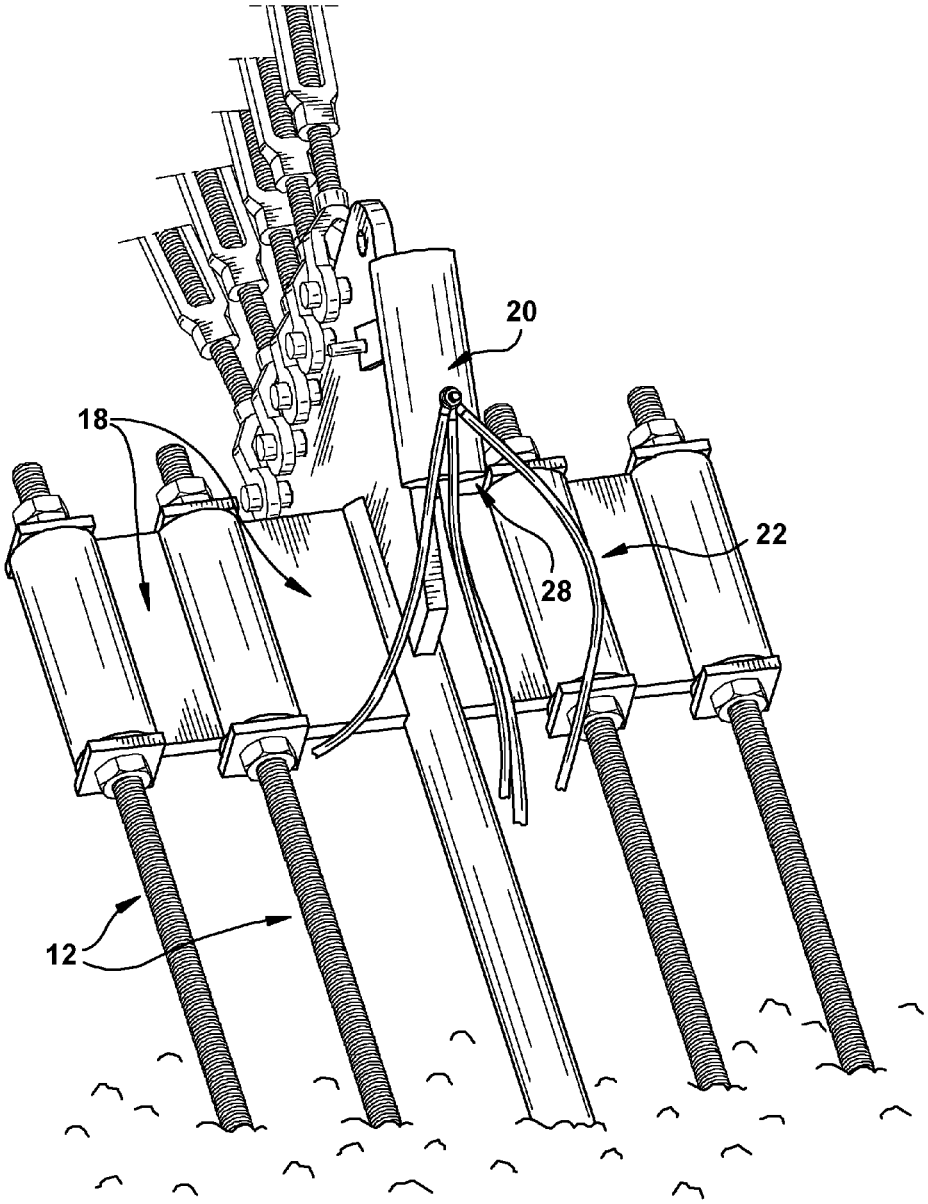
FIG. 4 is another drawing of above grade portion with cathodic protection of the present invention.

FIG. 4 is a drawing of one embodiment of the present invention which includes cathodic protection. Cathode testing head 20 is attached to assembly 10. One or more wires 22 attach from cathode testing head 20 to anodes and reference cells to lessen the environmental effects on the shafts. In one embodiment wire 22 attaching to anode bags which are located below grade. Anode bags being made from or containing more desirable materials for corrosion than the steel/metal of the apparatus. Alternatively wire extension 28 coming from the base of the testing head and leading to a reference cell below grade. Here a voltage test can be run to show the cell deterioration and the need for replacement of the anode bags. FIG. 4 also provides an embodiment where four remediation shafts 12 are utilized. Typically two remediation shafts are used, but customization to 1, 2, 3, 4, 5 or more remediation shafts are possible.

Figure 5:
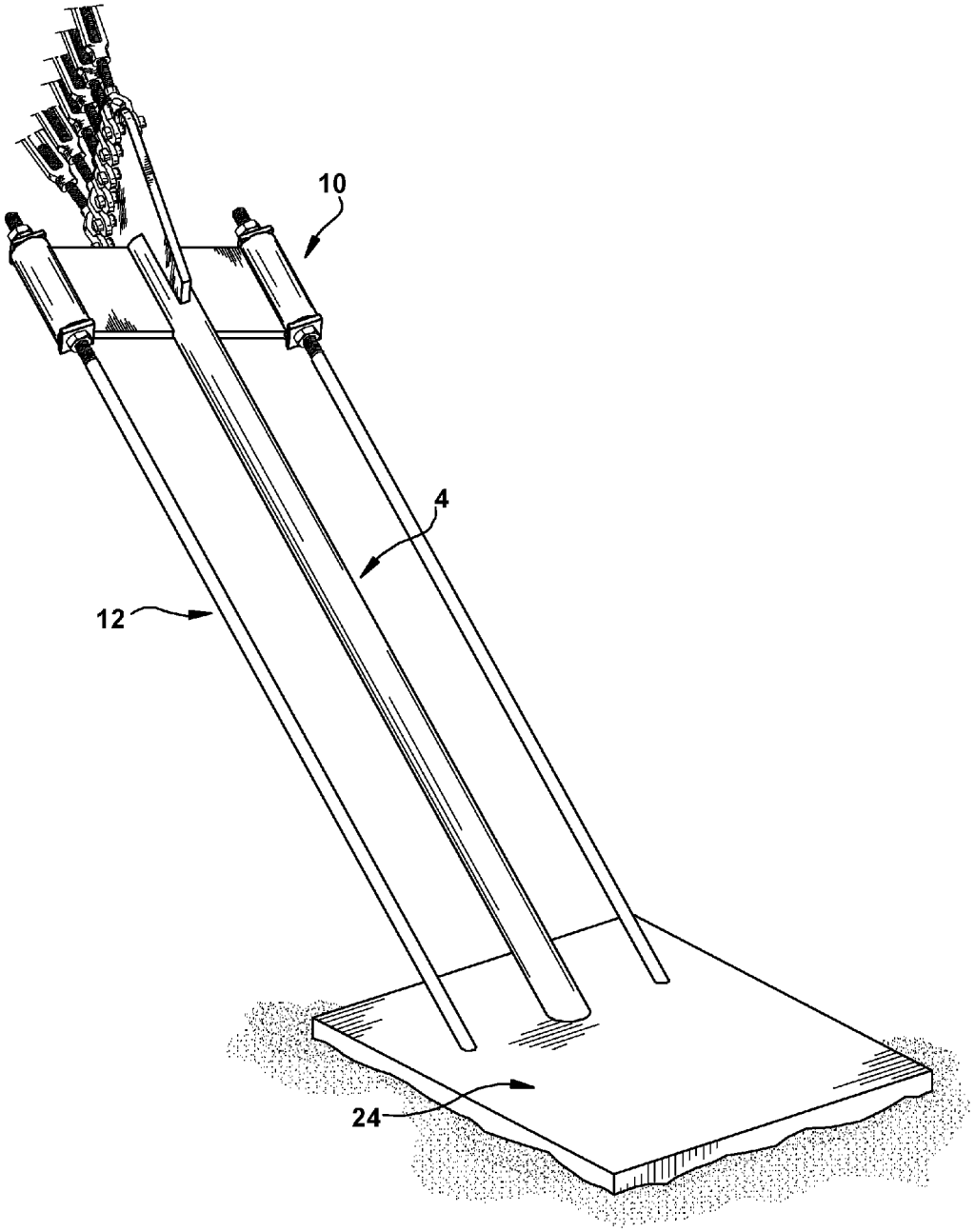
FIG. 5 is another drawing of above grade portion with concrete anchor of the present invention.

FIG. 5 is a drawing of an embodiment where remediation shafts 12 are attached to the original anchor 2. After attachment, the volume surrounding remediation shafts 12 is filled with concrete 24 to provide additional environmental protection and delay decay of the shafts. The filler used around remediation shafts 12 can be dirt, concrete (to encapsulate the rods), or stone/gravel to allow for drainage. Each type of fill depending on the climate and needs of the individual user. Another means of protecting remediation rods 12 involves coating with an epoxy or other material to prolong their lifespan.

Figure 6:
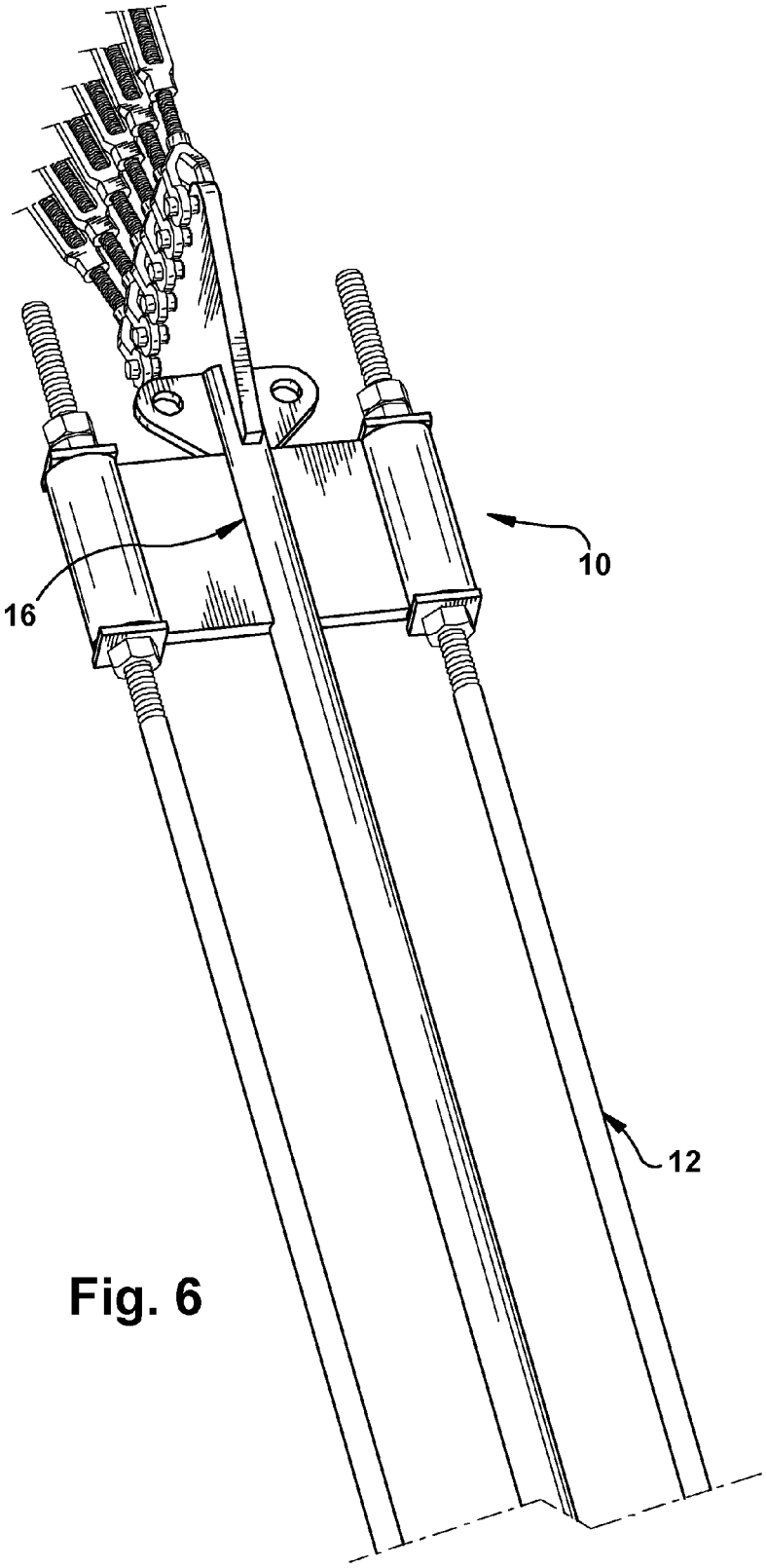
FIG. 6 is another drawing of above grade portion of the present invention.
Figure 7:
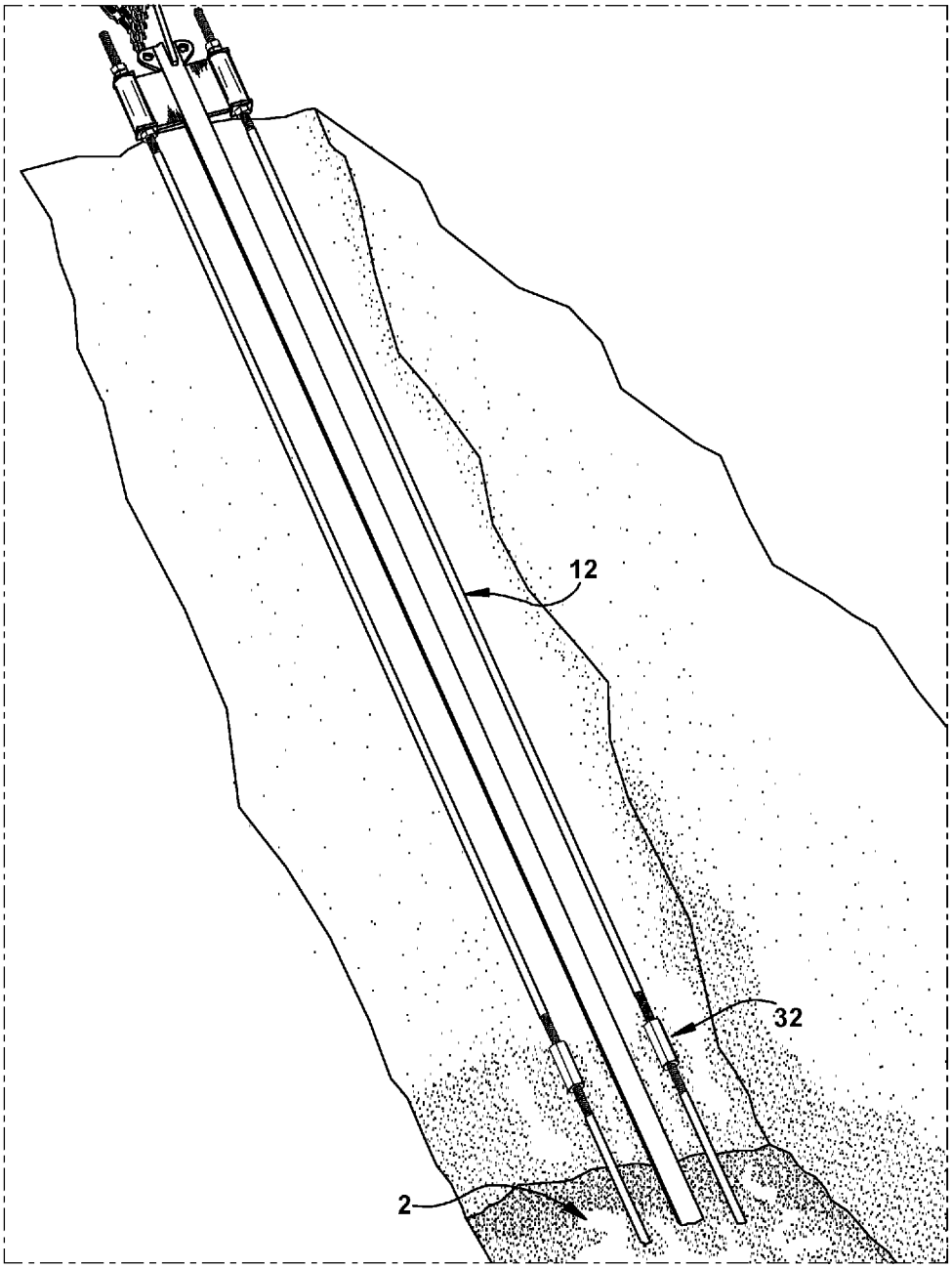
FIG. 7 is a drawing of an installation below grade of the present invention.

FIGS. 6 and 7 are drawings detailing the installation of assembly 10 and remediation rods 12. During installation, the area surrounding guy anchor shaft 4 down to anchor 2 is removed to have access to both. In this example, two attachment points would be made in anchor 2. Typically this involves drilling of two holes for insertion of remediation rods 12 into anchor 2. Remediation rods 12 can be inserted via a screw-in mechanism or can be inserted into a previously created void and then held in place with an epoxy or resin. Alternative means of securing remediation rods 12 into anchor 2 include, but are not limited to, concrete, resins, epoxies, polyurethane based products, polysulfide based products, bisphenol based epoxies, cured epoxy resins, or any other means which helps secure the two items. Other means of securing remediation rods 12 into anchor 2 include mechanical expansion bolts, through bolts or any means where the rod is inserted and allows for expansion of the inserted end via pressure or torque. Remediation rods 12 are attached to assembly 10 at the one or more remediation shaft receptacles 14. Assembly can then be welded or bolted to guy anchor shaft 4 at guy anchor shaft attachment 16. Assembly can also be welded or attached to guy anchor shaft attachment 16 as needed. Once remediation rods are secured and tightened to the torque or stress desired, the area around the guy anchor shaft 4 is replaced (filled back in). FIG. 7 also detailing coupling nut 32 which is used to extend the length of remediation rods 12.

Figure 8:
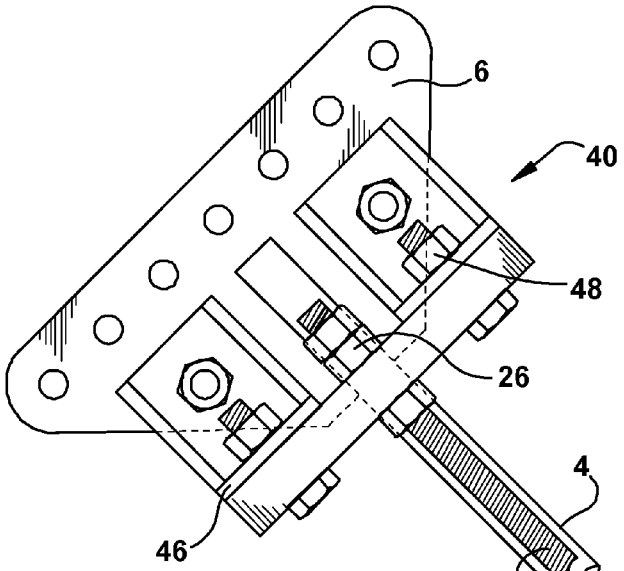
FIG. 8 is a drawing of the bolted version of the present invention.
Figure 9:
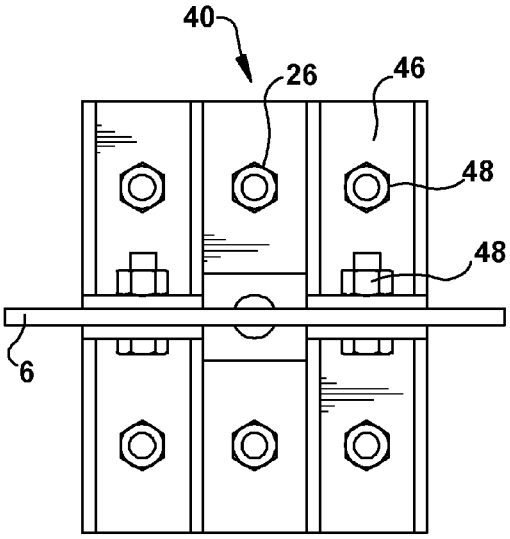
FIG. 9 is another drawing of the bolted version of the present invention.
Figure 10:
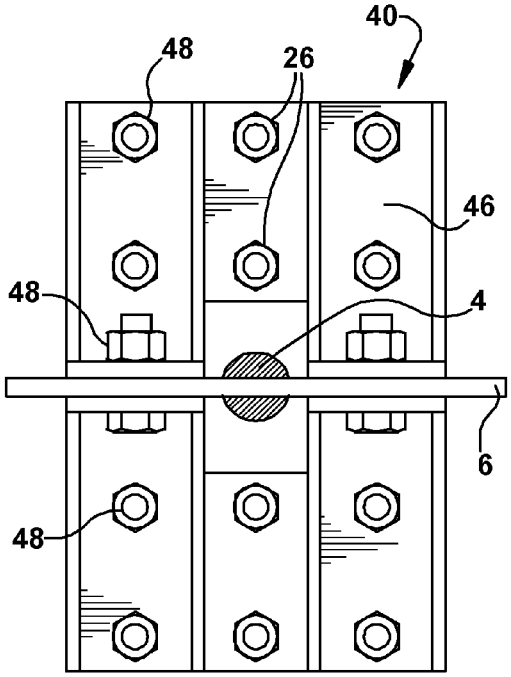
FIG. 10 is another drawing of the bolted version of the present invention.

FIGS. 8, 9 and 10 are drawings for one embodiment of the present invention where the assembly is a bolt-on assembly 40. Here bolt-on assembly 40 attaches to guy anchor fan plate 6 via a series of nuts, bolts 48 or some sort of fastener(s). In one embodiment bolt-on assembly 40 attaching thru holes (either drilled or previous existing) in guy anchor fan plate 6. The means of securing one or more remediation shafts 12 being shaft securing means 26 which can be a hex bolt, a square bolt or any other suitable fastening means. Here one or more remediation shafts 12 attaching to or protruding thru bolt-on assembly in the bolt remediation assembly portion 46. Bolt remediation assembly portion 46 having one or more attachment points and/or holes for attachment or corresponding remediation shaft(s) 12. FIG. 9 showing a bolt-on assembly 40 for using two remediation shafts 12 and FIG. 10 showing a bolt-on assembly 40 for using four remediation shafts 12.

Figure 11:
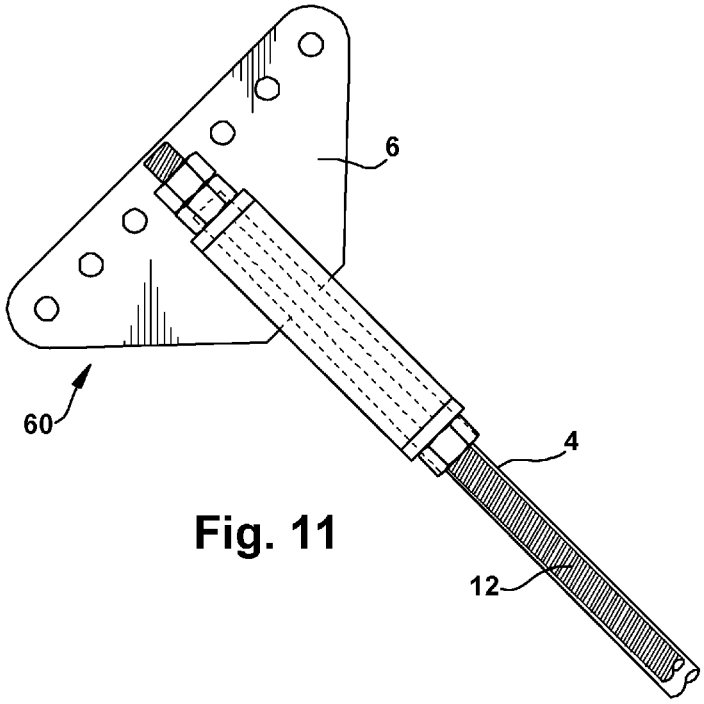
FIG. 11 is a drawing of the welded version of the present invention.
Figure 12:
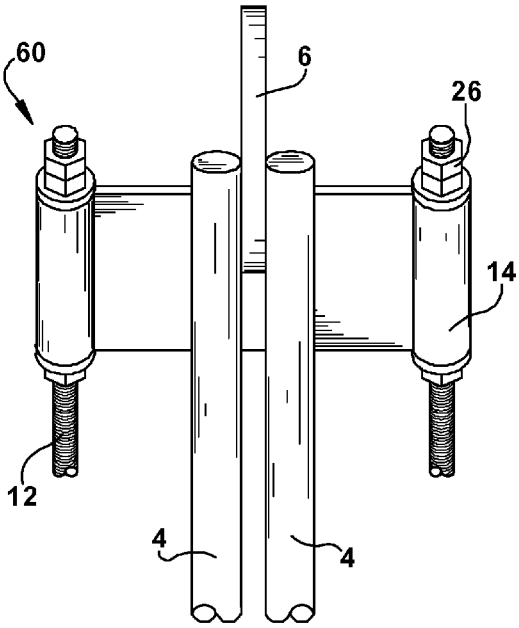
FIG. 12 is another drawing of the welded version of the present invention.
Figure 13:
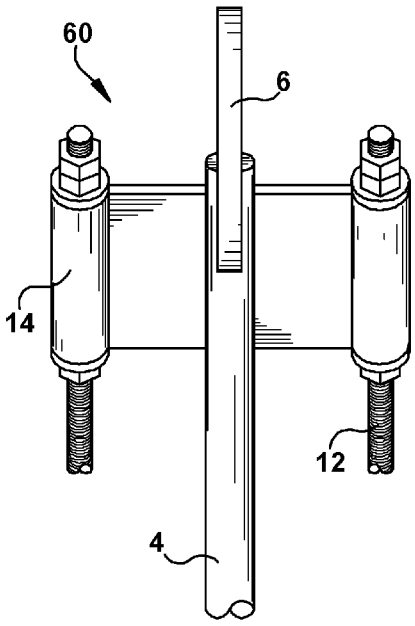
FIG. 13 is another drawing of the welded version of the present invention.

FIGS. 11, 12 and 13 are drawings for another embodiment of the present invention where the assembly is a welded assembly 60. Here welded assembly 60 is attached or secured to guy anchor fan plate 6 via a weld or similar attaching means. In one embodiment welded assembly 60 being secured to guy anchor fan plate 6 and further containing one or more remediation shaft receptacles 14. Remediation shaft receptacles 14 being able to receive remediation shaft 12 and secure using shaft securing means 26 such as a hex bolt, a square bolt or any other suitable fastening means. FIG. 12 showing a welded assembly 60 for using two remediation shafts 12 with two original anchor shafts 4 and FIG. 10 showing a welded assembly 60 for using two remediation shafts 12 with one original anchor shaft 4.

Figure 14:
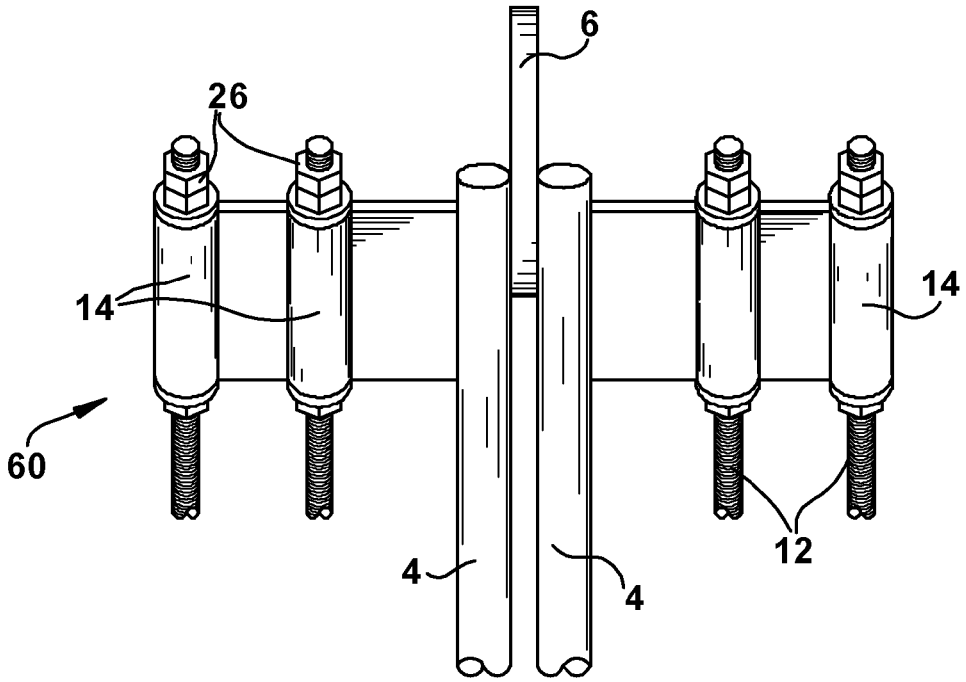
FIG. 14 is another drawing of the welded version of the present invention.
Figure 15:
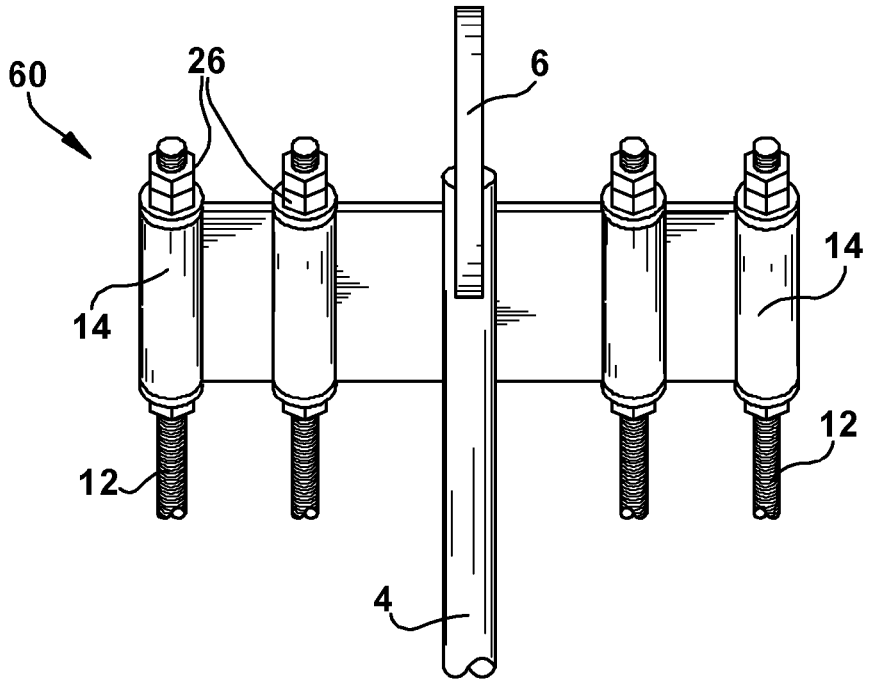
FIG. 15 is another drawing of the welded version of the present invention.

FIGS. 14 and 15 drawings for another embodiment of the present invention where the assembly is a welded assembly 60. Here welded assembly 60 is attached or secured to guy anchor fan plate 6 via a weld or similar attaching means. In one embodiment welded assembly 60 being secured to guy anchor fan plate 6 and further containing, in this embodiment, at least 4 remediation shaft receptacles 14. Remediation shaft receptacles 14 being able to receive remediation shaft 12 and secure using shaft securing means 26 such as a hex bolt, a square bolt or any other suitable fastening means. FIG. 14 showing a welded assembly 60 for using four remediation shafts 12 with two original anchor shafts 4 and FIG. 10 showing a welded assembly 60 for using four remediation shafts 12 with one original anchor shaft 4.

Care must be taken to properly size assembly 10 and remediation shafts 12 to ensure they can adequately handle the stresses and torques in the event guy anchor shaft 4 fails. In the examples shown in FIGS. 1 though 9, assembly 10 being from 8" to 48" in width across assembly from remediation shaft receptacle to receptacle. Both smaller and larger sizes being possible and covered herein based on an individual user needs.

While metal is preferred due to strength and longevity, other materials can be utilized for any or all of the components of the present invention. Such materials include, but are not limited to: plastics, metal alloys, and carbon fiber. In one embodiment each component preferring a different metal, such as plate being ASTM A572, pipe being ASTM A53-B, rods being ASTM F1554 or ASTM 722, nuts being ASTM A194 and washers being ASTM F436. These ASTM references being preferred but not limiting as any suitable arrangement is possible.

In one embodiment the anchor shaft being a solid cylindrical rod, Other embodiments including, but not limited to angled rods, channel rods and flat plate rods.

In one embodiment the anchor used by the remediation shafts being the original anchor used on the original system. In another embodiment, one or more additional anchors being used.

While the typical arrangement for remediation shafts 12 is one on each side of guy anchor shaft 4 (or planar setup), virtually any setup is possible including two, three or more per side, a cross pattern for 4 remediation shafts, or any other suitable arrangement. Typically symmetrical setups allowing for better placement of moment forces along a design system.

The standard means for securing remediation shafts 12 is via a shaft securing means 26. The typical shaft securing means 26 being a hex nut. Alternatively, this could be any number of apparatus or fastening means which locks remediation shaft 12 in place such as but not limited to a cotter pin, a square nut, cap or a direct weld.

The guy anchor remediation system disclosed herein provides a safer, less costly and permanent solution to corroding guy anchors than the conventional method of replacement. Upon completion, it results in no additional disturbance to the environment than the impact it had prior to the remediation. Furthermore there is no need to relocate guy wires to other anchor heads, which could possibly place undue stress or torque no the structure. In addition the guy anchor remediation system can strengthen existing anchor shafts found to be under-designed or require a size increase due to loading above the original design load.

It will be apparent to those skilled in the art that various modifications and variations can be made to the present disclosure without departing from the spirit and scope of the disclosure. Thus, it is intended that the present disclosure cover all conceivable modifications and variations of this disclosure, provided those alternative embodiments come within the scope of the appended claims and their equivalents. The various embodiments of the present invention described above may be combined together in any number and/or combination.

What is claimed is:

1. A method for installing a remediation system for a guy anchor shaft of a guyed structure or additionally guyed structure comprising:

removing material surrounding a guy anchor shaft to a level exposing at least a top side of an anchor;

making one or more attachment points in the anchor to accommodate one or more remediation shafts;

installing an assembly having one or more remediation shaft receptacles which accept and secure the one or more remediation shafts and also having a guy anchor shaft attachment which accepts and further secures to a guy anchor fan plate and/or the guy anchor shaft;

installing the one or more remediation shafts which extend from the assembly and are secured in the attachment points in the to an anchor;

aligning the one or more remediation shaft receptacles in parallel or at up to a 40 degree angle with the guy anchor shaft and affixing the one or more remediation shaft receptacles to the guy anchor shaft attachment via a joining plate.

2. The method for installing a remediation system of claim 1 further comprising returning at least part of the removed material.

3. The method for installing a remediation system of claim 2 where the returning at least part of the removed material comprises filling the removed material with concrete.

4. The method for installing a remediation system of claim 1 further comprising:

attaching a coupling to an exposed end of a partial remediation shaft where an opposed end of the partial remediation shaft is embedded in the anchor; and connecting a coupling end of the remediation shaft to the coupling, where the coupling end is opposite a remediation shaft receptacle end.

5. The method for installing a remediation system of claim 1 further comprising coating the one or more remediation shafts with an epoxy.

6. The method for installing a remediation system of claim 1 further comprising connecting a cathode testing head to the assembly.

7. The method for installing a remediation system of claim 6 further comprising establishing an electrical path between the cathode testing head and an anode.

8. The method for installing a remediation system of claim 6 further comprising establishing an electrical path between the cathode testing head and an anode disposed below grade.

9. The method for installing a remediation system of claim 6 further comprising testing an electrical condition between the cathode testing head and an anode.

* * * * *